United States Patent [19]

Hoffman

[11] 4,428,478

[45] Jan. 31, 1984

[54] SELF-LIMITING PUMP

[76] Inventor: Allan C. Hoffman, 2891 Rumsey Dr., Riverside, Calif. 92506

[21] Appl. No.: 396,011

[22] Filed: Jul. 7, 1982

[51] Int. Cl.[3] ..... B65D 83/00

[52] U.S. Cl. ..... 206/315.9; 417/307; 417/555 R; 220/231

[58] Field of Search ..... 206/315 B; 417/307, 417/311, 460, 555; 220/231, 366, 367; 215/262

[56] References Cited

U.S. PATENT DOCUMENTS

| | | | |
|---|---|---|---|
| 1,067,811 | 7/1913 | Harrison | 417/555 |
| 1,162,222 | 11/1915 | Clawson | 417/311 |
| 1,455,646 | 5/1923 | Millard | 417/311 |
| 1,471,441 | 10/1923 | Berg | 417/555 |
| 1,491,388 | 4/1924 | Foster | 417/555 |
| 2,539,846 | 1/1951 | Lewis et al. | 417/555 |
| 3,061,132 | 10/1962 | Geddes | 215/262 |
| 3,494,288 | 1/1970 | Watson | 417/307 |
| 3,723,025 | 3/1973 | Coakley | 417/307 |
| 3,853,222 | 12/1974 | Helms | 206/315 B |
| 3,888,347 | 6/1975 | Kramer | 220/366 |
| 4,012,174 | 3/1977 | Seibel et al. | 417/307 |
| 4,016,999 | 4/1977 | Denzer | 220/231 |
| 4,019,629 | 4/1977 | Dubner et al. | 417/555 |
| 4,278,114 | 7/1981 | Ruberg | 417/460 |
| 4,287,819 | 9/1981 | Emerit | 417/555 |
| 4,307,820 | 12/1981 | Binoche | 220/367 |

FOREIGN PATENT DOCUMENTS

| | | | |
|---|---|---|---|
| 2317186 | 2/1977 | France | 206/315 B |

*Primary Examiner*—William T. Dixson, Jr.
*Assistant Examiner*—David T. Fidei
*Attorney, Agent, or Firm*—Poms, Smith, Lande & Rose

[57] ABSTRACT

A pump mechanism primarily designed for use in sealing and pressurizing a container for tennis balls and the like. An alternate embodiment is adaptable for use in pressurizing items such as game balls and air-inflated shock absorbers and forks as used on motorcycles. The pump has a cylinder with a one-way valve at the outlet end. A piston is provided for moving longitudinally in and out of the cylinder to provide the pumping action. The piston is hollow and contains a second, spring-biased piston therein. The side wall of the piston contains a relief channel or hole at a pre-set distance from the bottom thereof. As the pressure in the pump increases, the piston within the piston is forced back against the increasing bias of the spring. When the biased piston moves sufficiently to expose the outlet channel or hole, the pressure limit of the pump is reached as any additional pressure is vented therefrom.

11 Claims, 9 Drawing Figures

SELF-LIMITING PUMP

BACKGROUND OF THE INVENTION

The present invention relates to air pumps and, more particularly, to small, hand-operated air pumps used for inflating game balls, game ball cannisters, and air-filled shock absorbers for motor cycles and the like.

The present invention is primarily directed towards apparatus for enclosing, sealing and pressurizing small containers such as tennis ball cans. Such devices are known in the art such as that exemplified in the patent to Helms (U.S. Pat. No. 3,853,222), FIG. 1 of which is reproduced in part as FIG. 1 of this application. In such a device, the cap, generally indicated as 10, is held in place on the top of a tennis ball can 12 by a collar 14 bearing against the rim 16 of the can 12. A flat gasket 18 which is disposed about the periphery of a sealing plate 20 bears against the rim 16 to seal the can 12. The sealing plate 20 has a hole 22 disposed therein over which is placed a rubber flapper valve 24. The upper portion of the cap 10 comprises a cylinder 26 in which is disposed a piston 28. The outer end of the piston 28 is formed as a gripping handle 30. The inner end of the piston 28 is fitted with a cup gasket 32 which allows air to flow past it on the upstroke of the piston 28 and seals against the side walls of the cylinder 26 on the downward or compression stroke.

Further modifications known in the art are shown in FIG. 2. For example, a release valve 34 is sometimes provided because the gasket 18 as thus configured tends to be so firmly wedged against the rim 16 initially in order to prevent leakage thereof that, once pressurized, it is virtually impossible to remove the cap from the can 12 without first releasing the pressure from within the can. Additionally, an integral gauge, such as that generally indicated as 36, is provided. Gauge 36 comprises a small piston 38 within a closed cylinder 40 which communicates with the inside of the can 12 through the hole 42. An air bubble 44 is trapped within the cylinder 40 above the piston 38 and sealed against leakage by a sealing material 46 such as heavy oil. The air bubble 44 acts as a bias against the piston 38 so that the piston 38 moves and compresses the bubble 44 as the internal pressure of the can 12 increases. Indicia of the pressure level is disposed along the outer surface 48 of the cylinder 40 so that the internal pressure of the can 12 can be determined, approximately, from the position of the piston 38, by visual inspection.

As a safety measure in such apparatus, a large area 50 is provided below the piston 28 within cylinder 26 at the bottom of its stroke thus limiting the amount of pressure which can actually be developed through pumping action. As a consequence, the volumetric efficiency of the pumps of such prior art caps 10 was very low and in order to achieve an internal pressure within the tennis ball can 12 of, for example, 15 psi, several hundred strokes of the piston 28 could be required.

Wherefore, it is an object of the present invention to provide a pumping mechanism for such uses which has a high volumetric efficiency while being safe against over pressurization.

It is yet another object of the present invention to provide a self-limiting pumping mechanism which will automatically cease pumping at a pre-selected pressure.

It is yet another object of the present invention to provide a sealing and pressurization cap for a tennis ball can which seals thereto without leakage while at the same time being removable without the necessity of a pressure release valve.

SUMMARY

The foregoing objectives have been achieved in a pump comprising a cylinder with a one-way outlet valve and a piston disposed in the cylinder for reciprocating, pumping, motion by the improvement comprising the piston having hollow portion in communication with the pump cylinder and a vent opening; a piston member disposed within the hollow portion, the piston member being moveable by the pressure being developed by the piston during its compression stroke between a first position blocking the vent opening and a second position exposing the vent opening; and, bias means for biasing the piston member towards the first position and for preventing the second position from being reached until the desired pressure limit of the pump is reached.

To achieve the various additional objectives, the vent opening produces an audible signal when the pressure limit is reached. Additionally, means are provided for releasably attaching the pump in field relationship over the open end of a cylindrical game ball container.

The desired sealing objectivies relative to the game ball container cap are provided by an externally threaded collar adapted for positioning around the container to bear against the bottom of the top rim thereof and an internally threaded cap carrying the pump and adapted to be threaded onto the collar, the cap having a sealing gasket disposed about the inner periphery thereof. In the preferred embodiment, the sealing gasket has a sealing surface disposed at about 45° to the top and sides of the cap whereby the gasket is wedged against the top surface of the top rim of the container as the cap is increasingly threaded onto the collar. Additionally, a retaining ring carried by the cap holds the gasket captured in the cap in its operating position while allowing the gasket to rotationally slip with respect to the cap if required as the cap is tightened.

DESCRIPTION OF THE DRAWINGS

FIG. 9 is an alternate embodiment of the pumping mechanism of the present invention as incorporated in a small hand pump suitable for inflating game balls and other apparatus such as air-filled shock absorbers for motorcycles and the like.

DESCRIPTION OF THE VARIOUS EMBODIMENTS

Figure 1:
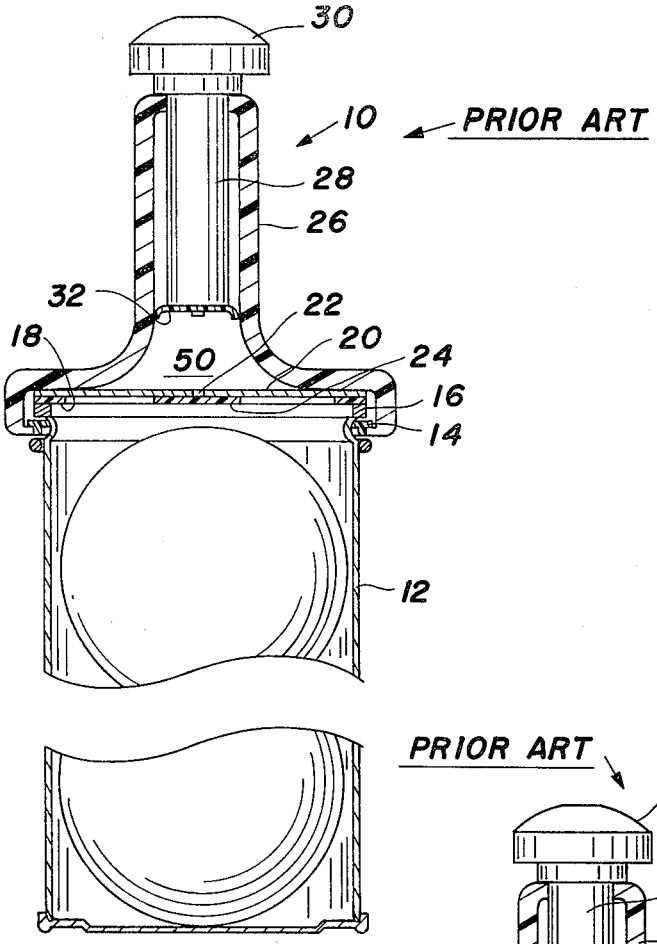
FIG. 1 is a cut-away view through a prior art sealing and pressurization cap for use on tennis ball cans.
Figure 2:
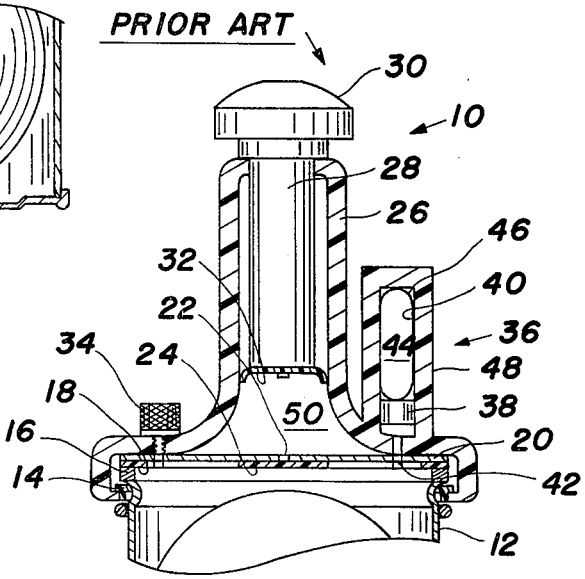
FIG. 2 is a cut-away version of just the cap portion of FIG. 1 showing modifications thereto known in the art for releasing pressure and for measuring pressure.
Figure 3:
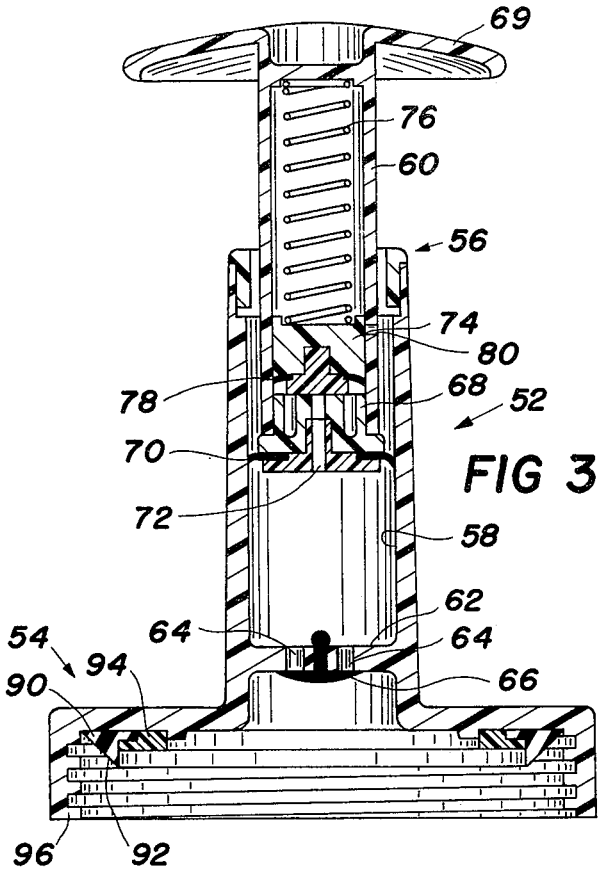
FIG. 3 is a cut-away elevation of a sealing and pressurization cap according to the present invention incorporating the unique pumping mechanism thereof therein.

Turning first to FIG. 3, a cap, generally indicated as 52, according to the present invention and adapted for use in the manner of the prior art caps 10 of FIGS. 1 and 2 is shown. Cap 52 comprises a sealing portion 54 adapted to be sealably and releasably attached to the top of a tennis ball can 12 in a manner to be described in greater detail hereinafter. Cap 52 also includes a pumping portion 56. Pumping portion 56 comprises a cylinder 58 into which a hollow cylindrical piston 60 is placed. The bottom end 62 of the cylinder 58 has holes 64 therethrough over which a rubber flapper-type valve 66 is placed. The bottom of the hollow cylindrical piston 60 is fitted with a plug 68 having a sealing gasket 70 disposed about the periphery thereof and a hole 72 therethrough communicating with the interior of the hollow cylindrical piston 60. The top is formed as a gripping handle 69. A slidable piston member 74 is disposed within the hollow cylindrical piston 60. The slidable piston member 74 is free to slide longitudinally within the hollow cylindrical piston 60 but is biased against the inner surface of the plug 68 by a bias spring 76. A sealing gasket 78 is also disclosed about the periphery of the piston member 74 to prevent the passage of air thereby. A hold 80 is disposed in the side wall of the hollow cylindrical piston 60 at a pre-established distance from the inner surface of the plug 68. Hole 80 could also be in the form of a channel or any other means for venting the pressure when the piston member 74 is forced back to that point.

Figure 5:
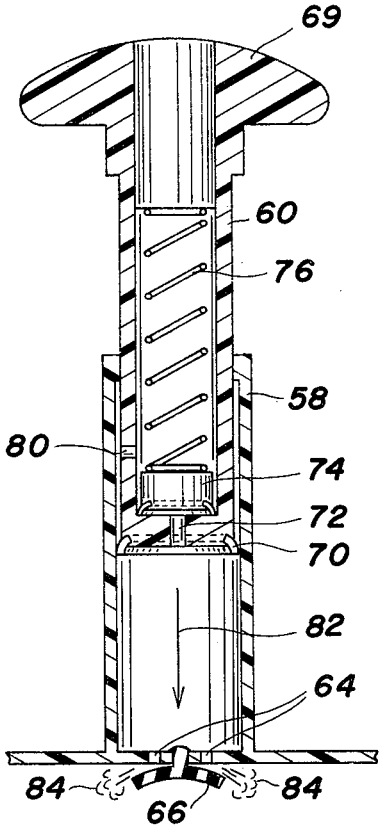
FIGS. 5 and 6 are simplified cut-away elevations of the cap of FIG. 3 showing the operation thereof.
Figure 6:
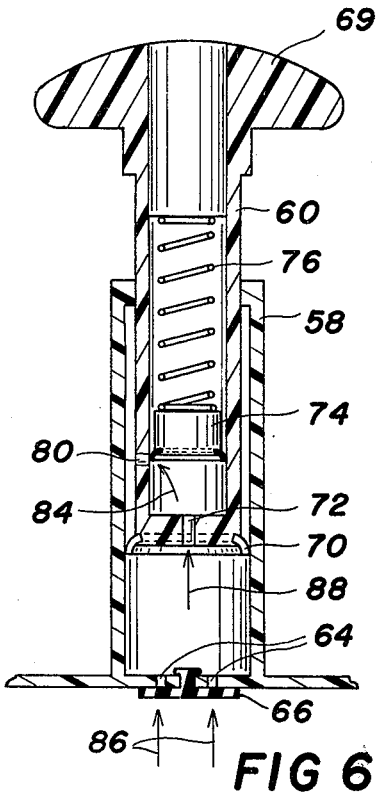

Turning briefly to FIGS. 5 and 6, the action of the pumping portion 56 is shown in simplified form. When the pressure within the can 12 is below the pre-set limit, as the hollow cylindrical piston 60 is moved downward in the direction of arrow 82, the air 84 is forced through the holes 64 under pressure into the can 12. As pressure builds up within the can 12, however, the situation shown in FIG. 6 develops. The back pressure of the air within the can, as symbolized by the arrows 86, maintains the flapper valve 66 over the hole 64 until the pressure within the space below the piston is greater than the pressure of arrows 86. The pressure below the piston 60, as symbolized by the arrow 88, passes through the hole 72 and pushes against the piston member 74 and, therefore, against the bias force of the spring 76. On each stroke of the piston 60, the pressure becomes greater and, therefore, the piston member 74 must move further against the increasing bias of spring 76 before the pressure equalizes and the flapper valve 66 opens. Eventually, the state shown in FIG. 6 is arrived at; that is, piston member 74 is forced sufficiently towards the gripping handle 69 such that the hole 80 is exposed and the air can pass therethrough. Thereafter, no further pressurization beyond that level attained can be achieved.

Figure 4:
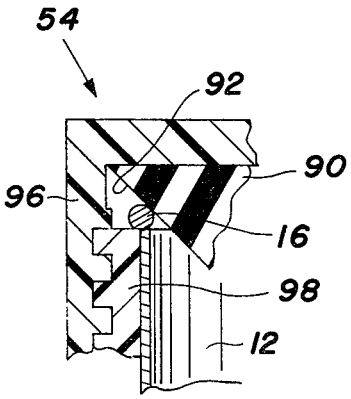
FIG. 4 is a detailed view of the mode of operation of the sealing gasket employed in the cap of FIG. 3.

Turning now to FIG. 4 in combination with FIG. 3, the unique sealing portion 54 will be discussed in greater detail. The rim 16 of the tennis ball can 12 is prone to irregularities and deformities. For this reason, the flat, loose gasket 18 of the prior art causes the above-described problems. Such prior art gaskets are also prone to mis-alignment and loss. For these reasons, the cap 52 of the present invention and the sealing portion 54 employs a captured wedge-shaped gasket 90 as shown. Gasket 90 has a sealing surface 92 which is oriented at 90° to the adjacent surfaces on the interior of the sealing portion 54. Gasket 90 is captured in place by a retaining ring 94 which is bonded to the inner surface of sealing portion 54. Gasket 90 can thus rotate with respect to the cap 52. In its preferred embodiment, the pump of the present invention is constructed of plastic. When so constructed, the retaining ring 94 can be of plastic as well and can be bonded by ultrasonic welding. To further accomplish the sealing objectives of the present invention, the edge 96 of the sealing portion 54 is internally threaded. In corresponding manner, the matching collar ring 98 which goes around the circumference of the can 12 to bear against the rim 16 is threaded on its external surface. In this manner, as the edge 96 is threaded onto the ring 98 to attach the cap 52 to the can 12, the sealing surface 92 of the wedge-shaped gasket 90 is increasingly forced in a wedging action against the rim 16 as it rotationally slips as necessary. The applicant herein has found that when so constructed, cap 52 can seal a tennis ball can 12 against leakage while, at the same time, being easily releasable with full internal pressure within the can 12. As desired as an object, therefore, a release valve 34 such as shown in the prior art cap 10 of FIG. 2 is no longer required.

Figure 7:
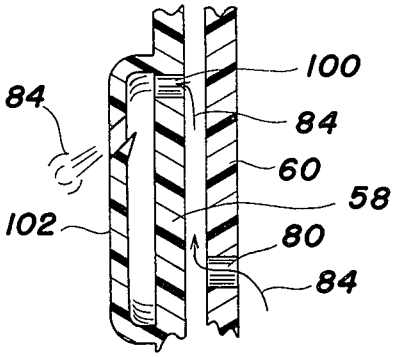
FIG. 7 is a simplified cut-away through the side wall of the pump of the present invention showing the addition of an optional noise producing device to provide an increased audible signal upon the attaining of the desired pressure.

Since the cap 52 of the present invention is self-regulating as to the terminal pressure attained within the can 12, a gauge 36 such as shown in FIG. 2 is no longer necessary. The pumping portion 56 is merely activated until the terminal pressure has been attained. Typically, with the construction as shown, about fifty strokes are required as opposed to the above-described several hundred required with the prior art apparatus. Arrival at the terminal pressure is detected by an audible hissing sound of the air escaping through the hole 80. If desired, an additional hole 100 can be provided in the side wall of the cylinder 58 and an air-actuated noise producing device 102 placed in communication therewith as shown in FIG. 7. When so constructed, the device 102 will emit a sound, more clearly providing an audible signal at the attaining of the desired internal pressure.

Figure 8:
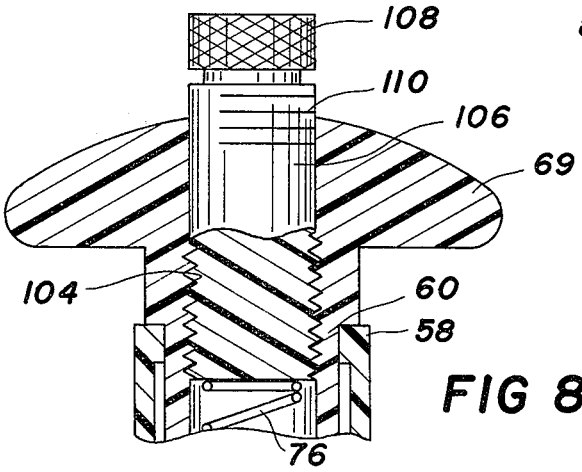
FIG. 8 is a cut-away elevation of the top of the pump of the present invention showing the addition of an adjustment to make the limiting pressure thereof adjustable.

A further modification to increase the versitility of the pumping portion 56 when employed in the cap 52, or otherwise as to be described hereinafter, is shown in FIG. 8. The gripping handle 69 has a partially threaded hole 104 therein into which a threated abutment member 106 is screwed. Member 106 has a knurled gripping portion 108 and pre-calibrated pressurization indicia 110 disposed on the outer surface thereof. The outer end of spring 76 abuts against member 106. By turning member 106 into or out of gripping handle 69, the amount of force on spring 76 can be adjusted and, therefore, the terminal pressure attained by the pumping portion 56 can be set. The indicia 110 allow the pumping portion 56 to be set to a specific desired level of pressurization.

Figure 9:
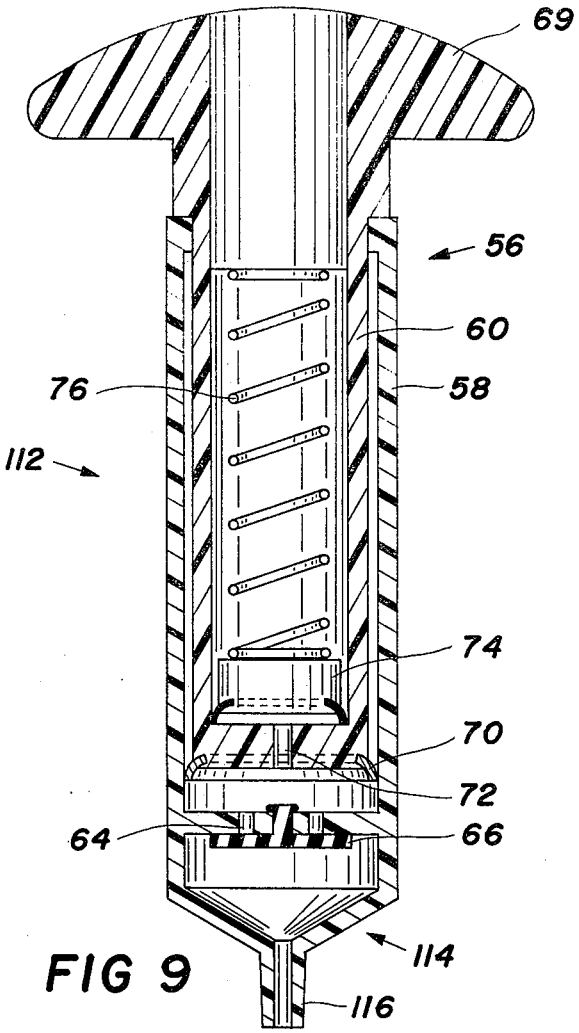

Turning now to FIG. 9, a pump 112 according to the present invention and suitable for pressurization of game balls or devices such as air-filled shock absorbers and air-filled forks on motorcycles and the like is shown. The pump 112 comprises a pumping portion 56 in the manner hereinbefore described. If desired, the modifications of FIGS. 7 and 8 can be employed therein as well. Whereas in the cap 52 of FIG. 3 the pumping portion 56 was operably connected to the sealing portion 54, in pump 112, the pumping portion 56 is connected to a nozzle portion 114. Nozzle portion 114 is generally funnel shaped and terminates in a small nozzle 116 which can be inserted into a game ball, or the like. As an alternative, nozzle 116 can be threaded such that a conventional air pressurization hose can be attached thereto for connection to game ball insertion needles or tire valve type connectors as employed in bicycle tires, air-filled forks and air-filled shock absorbers on motorcycles.

Wherefore, having thus described my invention, I claim:

1. In a pump comprising a cylinder with a one-way outlet valve and apiston disposed in the cylinder for reciprocating, pumping, motion, the improvement to pressure limit the pump comprising:

(a) the piston having a hollow portion in communication with the pump cylinder, said hollow portion having a venting opening;

(b) a piston member disposed within said hollow portion, said piston member being moveable by the pressure being developed by the piston during its compression stroke between a first position blocking said vent opening and a second position exposing said vent opening; and (c) bias means for biasing said piston member towards said first position and for preventing said second position from being reached until a desired pressure is attained in said cylinder whereby the pressure output of said pump is limited to said desired pressure.

2. The improvement to a pump of claim 1 wherein:

said vent opening produces an audible signal when said pressure limit is reached.

3. The improvement to a pump of claim 1 and additionally comprising:

a retaining ring carried by said cap and holding said gasket captured in said cap in its operating position while allowing said gasket to rotationally slip as necessary with respect to said cap.

4. The improvement to a pump of claim 1 and additionally comprising:

means for adjusting the bias force produced by said bias means whereby the pressure limit of the pump is adjustable.

5. A pressurization cap for a game ball container comprising:

(a) an externally threaded collar adapted for positioning around the container to bear against the bottom of the top ring thereof;

(b) an internally threaded cap adapted to be threaded onto said collar, said cap having a sealing gasket disposed about the inner periphery thereof;

(c) a cylinder carried by said cap having a one-way outlet valve communicating through said cap;

(d) a piston disposed within said cylinder for recriprocating, pumping, motion, said piston having a hollow portion in communication with the pump's cylinder, said hollow portion having a vent opening;

(e) a piston member disposed within said hollow portion, said piston member being moveable by the pressure being developed by the piston during its compression stroke between a first position blocking said vent opening and a second position exposing said vent opening; and (f) bias means for biasing said piston member towards said first position and for preventing said second position from being reached until a desired pressure is attained in said cylinder whereby the pressure output of said pump is limited to said desired pressure.

6. The pressurization cap of claim 5 wherein:

said vent opening produces an audible signal when said pressure limit is reached.

7. The pressurization cap of claim 5 and additionally comprising:

a retaining ring carried by said cap and holding said gasket captured in said cap in its operating position while allowing said gasket to rotationally slip as necessary with respect to said cap.

8. The pressurization cap of claim 5 and additionally comprising:

means for adjusting the bias level of said bias means.

9. A self-limiting air pump comprising:

(a) a cylinder with one-way outlet valve:

(b) a piston disposed in said cylinder for reciprocating, pumping, motion, said piston having a hollow portion in communication with said cylinder, said hollow portion having a vent opening;

(c) a piston member disposed within said hollow portion, said piston member being moveable by the pressure being developed by the piston during its compression stroke between a first position blocking said vent opening and a second position exposing said vent opening; and (d) bias means for biasing said piston member towards said first position and for preventing said second position from being reached until a desired pressure is attained in said cylinder whereby the pressure output of said pump is limited to said desired pressure.

10. The air pump of claim 9 wherein:

said vent opening produces an audible signal when said pressure limit is reached.

11. The air pump of claim 9 and additionally comprising:

means for adjusting the bias level of said bias means.

* * * * *